United States Patent [19]

Hack, Jr.

[11] 4,367,181

[45] Jan. 4, 1983

[54] CARBURETOR FLOAT CHAMBER EMERGENCY FUEL RESERVOIR APPARATUS

[76] Inventor: J. Roy Hack, Jr., 4363 E. Illinois St., Tucson, Ariz. 85714

[21] Appl. No.: 216,843

[22] Filed: Dec. 16, 1980

[51] Int. Cl.[3] ..... F02M 5/14

[52] U.S. Cl. ..... 261/70; 261/72 R; 261/71; 137/574; 137/572

[58] Field of Search ..... 137/574, 264, 255; 261/72 R, 70, DIG. 8, 71

[56] References Cited

U.S. PATENT DOCUMENTS

| | | | |
|---|---|---|---|
| 1,164,357 | 12/1915 | Kaufmann | 261/DIG. 8 |
| 1,435,001 | 11/1922 | Gilmore | 137/574 |
| 1,748,332 | 2/1930 | Ensign | 261/70 |
| 3,207,203 | 9/1965 | Mack | 137/574 X |
| 3,916,938 | 11/1975 | Hack | 137/256 |

*Primary Examiner*—Alan Cohan

*Attorney, Agent, or Firm*—H. Gordon Shields

[57] ABSTRACT

Emergency fuel chamber adjacent to a carburetor float chamber is filled from the float chamber and gasoline from the emergency chamber flows to the float chamber upon actuation of a valve.

10 Claims, 2 Drawing Figures

CARBURETOR FLOAT CHAMBER EMERGENCY FUEL RESERVOIR APPARATUS

BACKGROUND OF THE INVENTION

1. Field of the Invention

This invention relates to an emergency fuel chamber, and, more particularly, to an emergency fuel chamber disposed adjacent to a float chamber of a carburetor for providing fuel to an engine immediately after the normal fuel supply has been exhausted.

2. Description of the Prior Art

Most emergency fuel systems for providing fuel to engines when the normal or primary fuel supply is exhausted are located remotely from the carburetor. With such systems, the fuel line extending from the normal fuel supply to the carburetor is drained of fuel before the emergency fuel reservoir is actuated or is called upon to provide fuel for the engine. Hence, there is a period of time when the engine driven fuel pump, or an electrical fuel pump, is required to be actuted by using battery power before the engine begins to run. An example of such a system is shown in U.S. Pat. No. 3,916,938. The emergency fuel tank in the '938 patent is filled from the main fuel line which communicates directly with the fuel tank. The emergency fuel tank is actuated by a solenoid valve, or the like, which connects the emergency fuel tank to the regular fuel line.

With the apparatus of the '938 patent, the driver of the vehicle in which the apparatus is disposed must actuate the solenoid valve at the time that his engine stops running due to fuel starvation. The fuel starvation itself is signaled by stopping of the engine. After the emergency fuel tank is supplying fuel to the engine, there is a lag time while the engine is running, or is being cranked by battery power, while the fuel is flowing from the emergency tank to the carburetor from some type of fuel pump, either engine driven or electric. Under certain circumstances, the delay between running out of fuel and the flowing of the emergency fuel to the carburetor and thus to the engine may cause problems of varying degrees of seriousness. Accordingly, it is desirable to provide an emergency fuel system in conjunction with the carburetor so that upon actuation of the emergency fuel system, the fuel is virtually immediately available to keep the engine running.

The '938 patent, described above, represents a prior art approach to emergency fuel systems. There are no known patents which disclose an emergency fuel system in conjunction with a carburetor and which may be selectively actuated to provide fuel to the carburetor. However, there are several patents which disclose fuel chambers associated with carburetors, but such fuel chambers associated with the carburetors are not for the purpose of providing emergency fuel systems. Such chambers are generally considered overflow chambers which generally communicate either with the main fuel supply or with the float chamber for providing fuel to an engine operated at a relatively steep, inclined position or attitude. Several examples of such chambers, none of which are emergency fuel chambers, are shown in U.S. Pat. Nos. 1,252,440, 2,131,036, 3,020,030, 3,256,870, and 3,825,238.

None of the above-described patents discloses a reserve fuel chamber associated with the carburetor and which may be selectively actuated to provide fuel upon the exhaustion of the normal fuel supply to provide a fuel supply to the float chamber of an engine to allow the engine to continue running. The fuel system of the present invention may be used singly by itself or in conjunction with a larger emergency fuel system, such as disclosed in the '938 patent. If the apparatus of the present invention is used in conjunction with another, remote, emergency fuel supply, the engine may be kept running while the fuel is being pumped from the emergency fuel reservoir or tank to the float chamber. If the apparatus of the present invention is so used, then, when the fuel from the emergency reservoir or tank reaches the float chamber, the filling of the float chamber will also again refill the emergency reservoir at the carburetor float chamber, and thus the emergency or reserve chamber returns to its original function as an emergency fuel supply, providing the valve between it and the float chamber is closed so as to trap the emergency fuel.

SUMMARY OF THE INVENTION

The invention described and claimed herein comprises an emergency fuel reservoir disposed adjacent to a carburetor float chamber and connected to the float chamber at the top of the float chamber for filling purposes and at the bottom of the float chamber for allowing the fuel from the emergency chamber to flow into the float chamber to provide substantially immediately a supply of fuel to continue running the engine. Communication between the float chamber and the emergency chamber at the bottom of the two chambers is provided by an aperture extending through a common wall, with the aperture controlled by a remotely actuable valve.

Among the objects of the present invention are the following:

To provide new and useful reserve fuel tank apparatus;

To provide new and useful emergency fuel tank apparatus connected to a carburetor;

To provide new and useful emergency fuel chamber at a carburetor float chamber;

To provide a valve controlled emergency fuel supply for a carburetor float chamber; and To provide a remotely actuated valve control emergency fuel chamber adjacent to the float chamber of a carburetor.

DESCRIPTION OF THE PREFERRED EMBODIMENT

Figure 1:
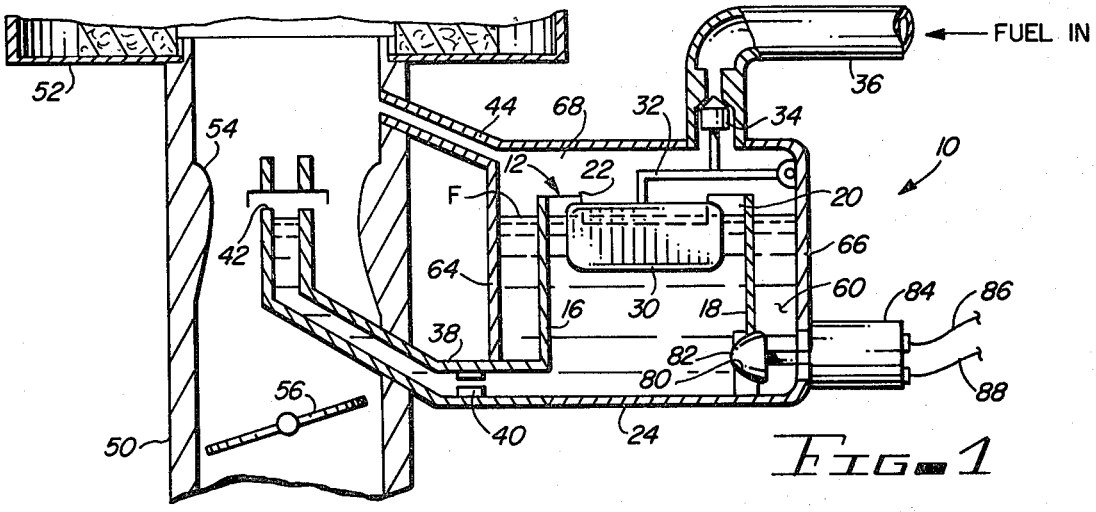
FIG. 1 is a view in partial section of the apparatus of the present invention.
Figure 2:
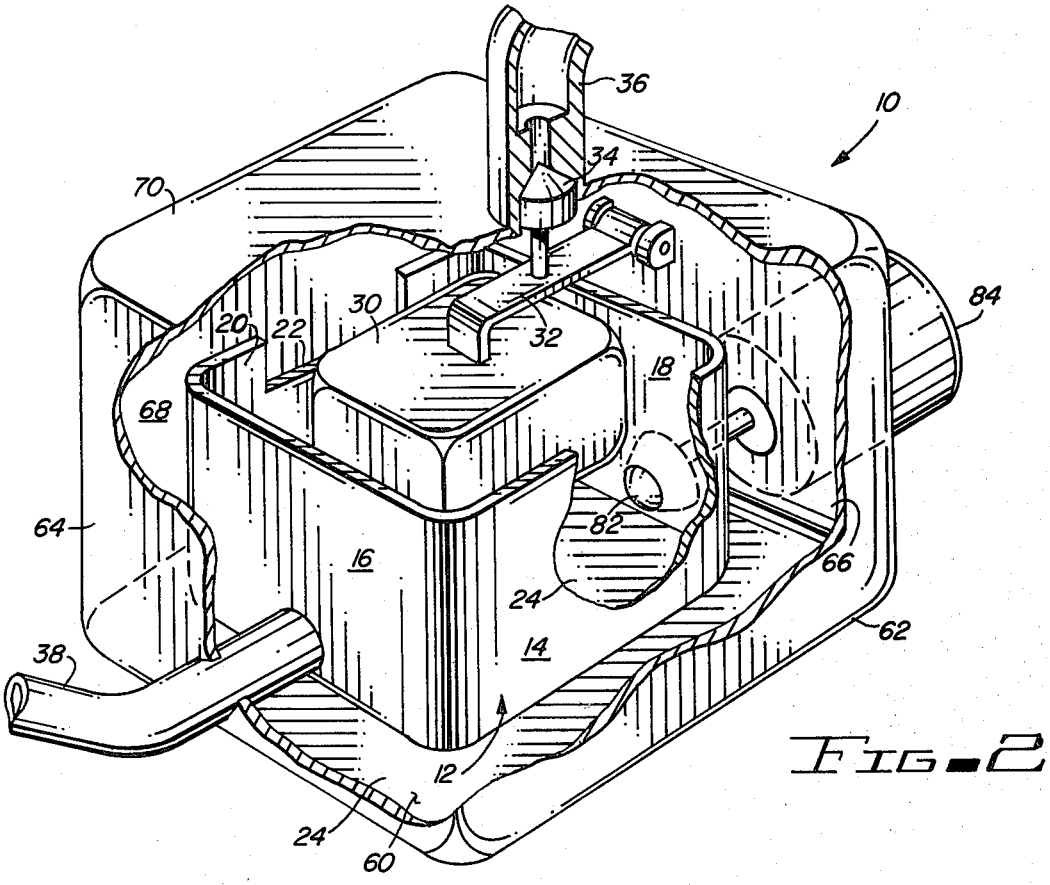
FIG. 2 is a perspective view of the apparatus of the present invention, with portions broken away to illustrate details of the present invention.

FIG. 1 is a view in partial section of a carburetor 10 which includes an emergency fuel reservoir. FIG. 2 is a perspective view of the carburetor apparatus 10 of FIG. 1, with portions of various walls of the carburetor 10 broken away, illustrating details within the carburetor 10. For the following discussion, reference will be made to FIGS. 1 and 2.

While the term "carburetor" is used broadly herein, it will be understood that the apparatus of the present invention pertains to a float chamber of a carburetor, with an emergency fuel reservoir disposed around the float chamber. Only portions of generalized or schematic representations of a carburetor are illustrated in FIGS. 1 and 2. The portions illustrated are primarily a float chamber, with the various elements of the present invention associated therewith. With respect to FIG. 1, an associated venturi or throat of a barrel of a carburetor, with a throttle therein, is shown for purposes of illustrating the apparatus of the present invention. The represenation of FIGS. 1 and 2 is schematic in character, and does not purport to be a particular type or model carburetor or a float chamber associated with any particular carburetor, other than a down draft carburetor. It will be understood, however, that the apparatus of the present invention is not limited to a downdraft carburetor. However, since downdraft carburetors are the most popular type of carburetor in use in internal combustion engines of the automotive type today, a downdraft carburetor is illustrated.

The carburetor 10 includes a float chamber 12, with a float 30 disposed therein. The float chamber includes four walls, a first side wall 14, a front wall 16, a rear wall 18, and a second side wall 20. The top of the side wall 20 includes a cut-out or relieved portion 22 which extends downardly from the top of the wall 20. The length of the cut-out portion 22 is somewhat less than the overall length of the side walls 14 and 20, which side walls are substantially parallel to each other. The height of the cut-out portion 22 is such that in the normal course of the filling of the float chamber 12, the fuel from the float chamber 12 flows over the cut-out portion 22 to fill a reserve chamber 60 disposed about the chamber 12. The float chamber 12 also includes a bottom wall 24. The walls 14, 16, 18, and 20 are subtantially perpendicular to the floor 24, and they extend upwardly therefrom.

The walls 14, 16, 18, and 20 of the float chamber 12 comprise or define partitions which separate the float chamber 12 from the reserve or emergency fuel chamber 60. The auxiliary or reserve fuel chamber 60 includes four walls 62, 64, 66, and 68 which are disposed substantially parallel to, and spaced apart from the float chamber walls 14 . . . 20. The float chamber 12 and the reserve fuel chamber 60 use the common floor or bottom wall 24. A top wall 70 is also common to both chambers, although it is secured to the outer four walls 62 . . . 68 of the reserve chamber 60. The inside walls of the emergency fuel chamber 60 are the walls 14, 16, 18, and 20 of the float chamber 12. The walls 14 . . . 20 are accordingly common to both chambers 12 and 60, as are the bottom and top walls 24 and 70, respectively.

Fuel flows into the float chamber 12 through a fuel supply line 36. The fuel supply line 36 is connected to a fuel tank (not shown) and a fuel pump (not shown) causes the fuel to flow from the fuel tank to the float chamber 12. A needle valve 34 controls the flow of fuel from the fuel line 36 into the float chamber 12. As is common, and well understood, the float 30 pivots on a rod 32 which is secured at one end to the float 30 and at its opposite end to the wall 66. The needle valve 34 is in turn secured to, or moves in response to, the rod 32. The rod 32, secured to the wall 66, pivots in response to the height of the fuel in the float chamber 12. As fuel is drawn out of the float chamber 12, the float 30 moves downwardly, opening the needle valve 34 and allowing more fuel to flow from the line 36 into the float chamber. As the height of the fuel increases in the float chamber 12, the needle valve 34 restricts the flow of fuel into the float chamber.

Fuel flows out of the float chamber 12 into an air induction pipe or conduit 50 through a fuel supply line 38. Within the line 38 is an orifice or main jet 40. The line 38 terminates within the induction conduit 50 in a fuel outlet orifice 32. The induction conduit 50 is closed at one end by an air filter 52, and extends downwardly to an intake manifold (not shown). The air flowing through the air filter 52, and into the induction conduit or air horn 50, flows through a venturi 54, which is disposed above a throttle 56. The fuel conduit 38 extends into the venturi 54, and the fuel outlet orifice 42 is disposed within the venturi 54. As is well known and understood, the velocity of the air flow in the induction conduit 50 is at a maximum through the venturi 54. The pressure of the air flow is accordingly, or correspondingly, at its lowest at the venturi. This causes the fuel to flow out of the line 38 and through the orifice 42 and into the air flow. It will be noted that there is no attempt in the drawing to show all of the details of the carburetor, its idling system, choke, etc. Only a minimum number of elements is shown; only those elements considered significant in explaining the operation of the present invention are shown. The fuel supply conduit 38 is shown, as is a vent or balancing tube 44. The vent tube or balancing tube 44 connects with the induction conduit 50 above the venturi 54 and communicates with the float chamber 12, and also with the auxiliary or reserve fuel chamber 60, to provide air at atmospheric pressure, or near atmospheric pressure, into the float chamber 12 and the reserve chamber 60.

When the float chamber 12 fills with fuel, the auxiliary or reserve chamber 60 also fills with fuel by virture of the cutout 22 in the common wall 20 between the two chambers. As best shown in FIG. 1, the bottom of the cutout 22 is below the surface of the fuel F in the float chamber 12, and the level of the fuel F in the chamber 60 is the same as the level of the fuel in the chamber 12 when the chamber 12 is full. As will be understood, when the level of the fuel in the chamber 12 drops, due to the demand of the engine to which the carburetor 12 is secured, the level of the fuel F in the auxiliary or reserve chamber 60 will drop only as low as the bottom of the cutout 22. After that particular level is reached, fuel remains in the auxiliary or reserve chamber 60 even though the fuel level may drop within the float chamber 12, until the fuel flowing through the fuel line 36, together with the demand for the fuel with respect to the engine, allows the level of the fuel in the float chamber 12 to increase.

If the fuel flow through the fuel line 36 ceases, for any reason, the demand for fuel from the engine will utilize all of the fuel in the float chamber 12, and, under ordinary circumstances, the engine will ultimately stop due to fuel starvation. However, with the reserve fuel chamber 60, the engine may continue to operate since fuel will be immediately available to the fuel supply conduit 38 into the air horn or induction pipe 50. When the driver of the vehicle to which the apparatus 10 is secured realizes that the engine has fuel starvation problems, an electrical switch (not shown) is actuated to provide fuel from the auxiliary or reserve chamber 60 to the float chamber 12. This is accomplished by means of a solenoid 84 which is in turn connected to the electrical switch through a pair of conductors 86 and 88.

A valve seat 80 extends through the partition or wall 18 of the float chamber 12. The wall 18, as indicated above, is common to the chambers 12 and 60. The valve seat 80 comprises an aperture in the wall 18 disposed or located at the bottom thereof, adjacent the bottom of floor 2. As best shown in FIG. 1, the thickness of the wall 18 may be increased somewhat, for reinforcement purposes, at the valve seat or aperture 80.

A valve 82 extends into the aperture or valve seat 80 to prevent the flow of liquid between the chambers 60 and 12. The 82 is in turn connected to the solenoid 84. The stem of the valve 82 comprises the plunger or armature of the solenoid 84. The valve 82, as is well known and understood, is preferably spring loaded to its off or extended position, as shown in FIGS. 1 and 2. Upon actuation of the solenoid 84, the solenoid's plunger retracts into the solenoid 84, withdrawing the valve 82, which is secured to the plunger, from the aperture 80. With the aperture or valve seat 80 opened or uncovered, fuel from the reserve chamber 60 is immediately available to the float chamber 12, and thus immediately available to the fuel line 38 to keep the engine running.

With the apparatus of the present invention, namely the reserve fuel chamber 60 disposed about the float chamber 12, fuel is immediately available to the engine to keep the engine running. There is thus no lost time required for fuel to be pumped by an engine-driven fuel pump from a remote location to the float chamber. Such pumping by an engine driven fuel pump is generally required to be accomplished by the battery operated cranking (starting) motor since the engine will have died by virtue of fuel starvation. Even with an electric fuel pump, there is a time lapse for the fuel to flow from a remote emergency tank to the carburetor. With the emergency or reserve fuel chamber 60, the engine continues to run. The user of the car realizes that the normal gas tank is empty and must be replenished immediately to forestall further problems.

The apparatus of the present invention may be used in conjunction with a remote fuel reserve tank, if desired. Upon actuation of the solenoid 84, the engine continues to run and thus an engine driven, or electric, fuel pump may be used to provide fuel to the float chamber 12 from an auxiliary source, remote from the carburetor 10. The engine driven, or electric, fuel pump thus provides a flow of fuel with the engine running, rather than with the engine turned off.

What is claimed is:

1. Reserve fuel apparatus for a carburetor, comprising, in combination:

a float chamber in the carburetor for receiving a flow of fuel;

a float in the float chamber for controlling the flow of fuel into the float chamber; and reserve fuel chamber means disposed adjacent to the float chamber, including a reserve fuel chamber, means for filling the reserve fuel chamber from the flow of fuel into the float chamber, and means for providing a flow of fuel from the reserve fuel chamber to the float chamber.

2. The apparatus of claim 1 in which the means for providing a flow of fuel from the reserve fuel chamber to the float chamber includes conduit means for providing communication between the reserve fuel chamber and the float chamber.

3. The apparatus of claim 2 in which the means for providing a flow of fuel from the reserve fuel chamber to the float chamber further includes valve means for controlling the flow of fuel through the conduit means from the reserve fuel chamber to the float chamber.

4. The apparatus of claim 2 in which the reserve fuel chamber means includes a plurality of walls defining the reserve fuel chamber, at least one of which walls is common to both the float chamber and the reserve fuel chamber.

5. The apparatus of claim 4 in which the means for filling the reserve fuel chamber from the flow of fuel in the float chamber comprises a cut-out portion in the common wall between the float chamber and the reserve fuel chamber whereby fuel in the float chamber flows through the cut-out portion into the reserve fuel chamber.

6. The apparatus of claim 1 in which the reserve fuel chamber means includes a reserve chamber disposed about the float chamber, a plurality of side walls common to both the float chamber and the reserve chamber, and a bottom wall common to both the float chamber and the reserve chamber.

7. The apparatus of claim 6 in which the means for filling the reserve chamber from the flow of fuel in the float chamber includes a cut-out portion in one of the common side walls between the float chamber and the reserve chamber remote from the common bottom wall.

8. The apparatus of claim 7 in which the means for providing a flow of fuel from the reserve chamber to the float chamber includes an aperture in one of the common side walls between the float chamber and the reserve chamber disposed adjacent to the common bottom wall.

9. The apparatus of claim 8 in which the means for providing a flow of fuel from the reserve chamber to the float chamber further includes a valve movable with respect to the aperture and controlling the flow of fuel from the reserve chamber to the float chamber through the aperture.

10. The apparatus of claim 8 in which the means for providing a flow of fuel from the reserve chamber to the float chamber further includes a solenoid connected to the valve and remotely actuable to move the valve with respect to the aperture.

* * * * *